US005992442A

United States Patent [19]

Urquhart et al.

[11] Patent Number: 5,992,442

[45] Date of Patent: Nov. 30, 1999

[54] RELIEF VALVE FOR USE WITH HERMETICALLY SEALED FLEXIBLE CONTAINER

[76] Inventors: Edward F. Urquhart, 191213 SE. 43rd Pl., Issaquah, Wash. 98027; Mark A. Honnell, 3555 Lone Mountain Trail, Rathdrum, Id. 83858

[21] Appl. No.: 08/865,280

[22] Filed: May 29, 1997

[51] Int. Cl.[6] ..... F16K 13/00; F16K 15/00

[52] U.S. Cl. ..... 137/246; 137/533.17; 137/533.19

[58] Field of Search ..... 137/533.17, 533.19, 137/246, 854; 383/100, 103, 533

[56] References Cited

U.S. PATENT DOCUMENTS

| | | | |
|---|---|---|---|
| 55,531 | 6/1866 | Peabody | 137/533.19 |
| 914,122 | 3/1909 | Vilbiss | 137/533.19 |
| 1,180,989 | 4/1916 | Enger | 137/533.19 |
| 2,320,888 | 6/1943 | Reifenberg . | |
| 2,361,344 | 10/1944 | Yates . | |
| 2,638,263 | 5/1953 | Jennig . | |
| 2,738,091 | 3/1956 | Mattox . | |
| 2,870,954 | 1/1959 | Kulesza . | |
| 3,195,283 | 7/1965 | Broersma . | |
| 3,245,669 | 4/1966 | Huggins et al. | 137/533.17 |
| 3,292,652 | 12/1966 | Gallone . | |
| 3,302,859 | 2/1967 | Perry . | |
| 3,319,836 | 5/1967 | Cubitt . | |
| 3,371,849 | 3/1968 | Rochla . | |
| 3,424,063 | 1/1969 | Norwood . | |
| 3,430,842 | 3/1969 | Yamaguchi . | |
| 3,432,087 | 3/1969 | Costello . | |
| 3,670,760 | 6/1972 | Butcher et al. . | |
| 3,799,427 | 3/1974 | Goglio | 137/854 |
| 4,222,407 | 9/1980 | Ruschke et al. . | |
| 4,444,219 | 4/1984 | Hollenstein | 137/246 |
| 4,966,535 | 10/1990 | Lina et al. | 137/533.19 |
| 5,388,620 | 2/1995 | Lasserre et al. | 137/854 |
| 5,405,038 | 4/1995 | Chuang | 137/854 |

*Primary Examiner*—Denise L. Ferensic
*Assistant Examiner*—Joanne Y. Kim
*Attorney, Agent, or Firm*—Paul L. Griffiths

[57] ABSTRACT

A pressure relief valve for use with flexible containers holding coffee, especially ground coffee, is disclosed. The valve incorporates a unique two piece structural arrangement that requires a low level of precision compared to similar valves. The valve comprises a valve body including a valve chamber having a resilient diaphragm located therein for opening and closing the valve. A set of valve retainers formed integral with the valve body ensure that the diaphragm remains within the valve chamber. A viscous liquid helps ensure an air-tight seal and also acts to retain the diaphragm against a valve seat within the valve chamber. Inlet slots are sized and shaped to effectively prevent coffee grounds from entering the valve without need of a filter or filter paper.

14 Claims, 1 Drawing Sheet

FIG. 1
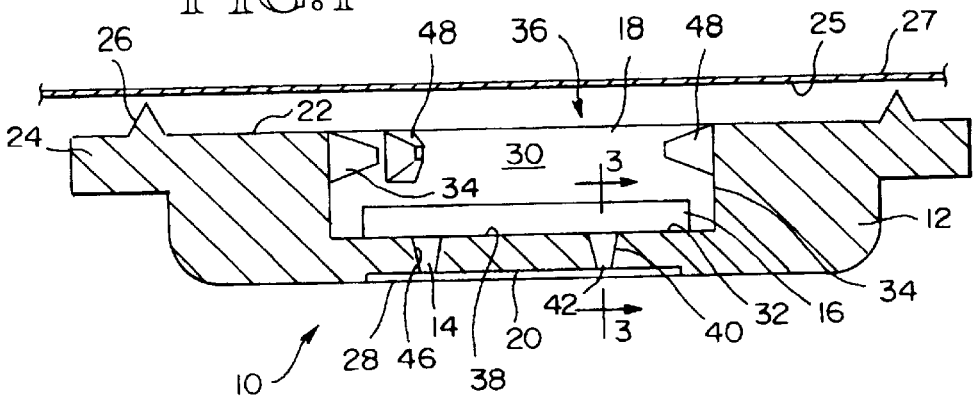
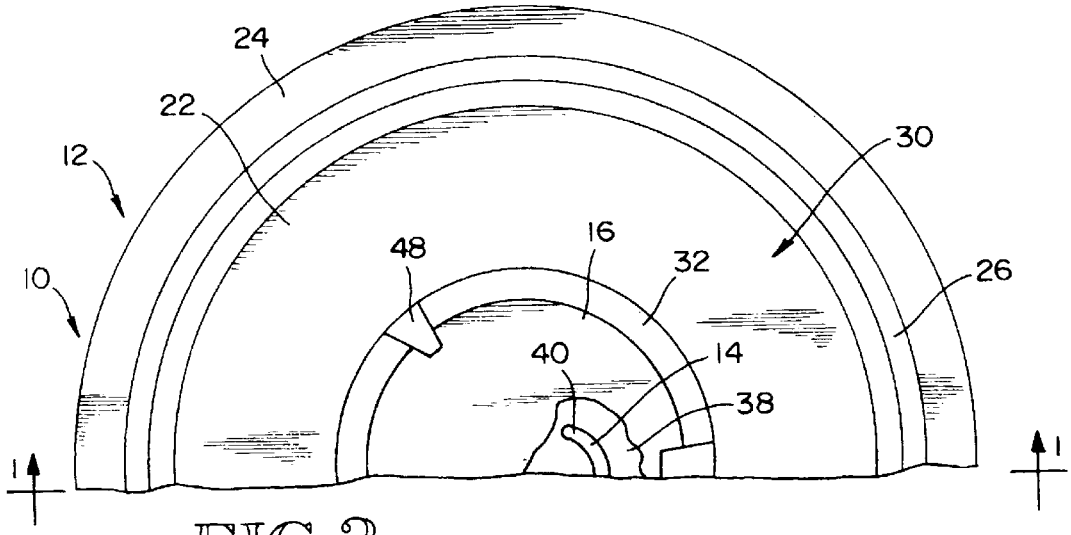
FIG. 2
FIG. 3
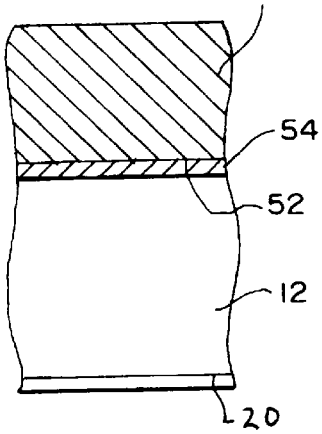
FIG. 4
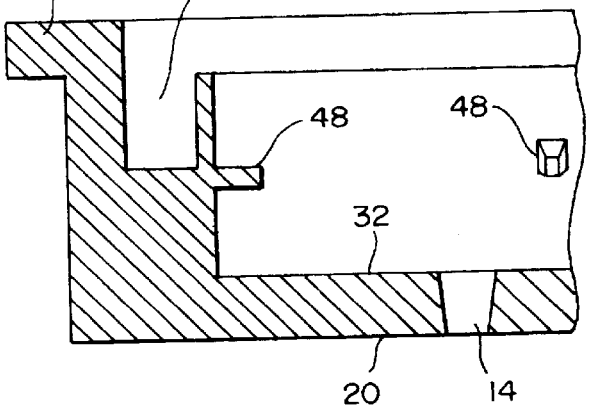

RELIEF VALVE FOR USE WITH HERMETICALLY SEALED FLEXIBLE CONTAINER

BACKGROUND OF THE INVENTION

1. Field of the Invention

The present invention relates to check valves or safety relief valves for use with flexible containers for use with coffee. Relief valves allow excess pressure in a container to be relieved while not allowing outside air into the container.

2. Description of Related art

Fresh roasted coffee gives off carbon dioxide (CO2) for an average of twenty-two (22) days after roasting. A relief valve is required when using flexible containers to store and transport freshly roasted coffee due to the pressure build up of the CO2 within the container. Without a relief valve flexible containers have been known to burst due to the gas pressure buildup. Use of relief valves allows a coffee roaster to package coffee immediately after roasting instead of having to store the coffee for three to five (3–5) days.

Relief valves have to function whether whole bean or ground coffee is placed in the flexible containers. In the case of ground coffee, small grains of coffee can cause a relief valve to stop functioning which in turn causes the container to inflate with CO2 and potentially burst. A simple, economical, relief valve is the object of the present invention.

Various forms of relief valves have been used with some success. One such valve is disclosed in U.S. Pat. No. 4,420,015, issued Dec. 13, 1993 to Hans Blaser. This valve utilizes a valve body having a carrier plate with a lateral edge flange with a central shallow recess for receiving a flexible diaphragm and a clamping member with jaws that is held in place by an inside rim of the recess. The diaphragm is made of a very thin soft plastic such as a polyester film. A silicone oil is used between the diaphragm and a valve seat within the recess. The silicone oil is used to help ensure a secure seal.

Another such valve is disclosed in U.S. Pat. No. 3,595, 467, issued on Jul. 27, 1971 to Luigi Goglio. The valve disclosed therein includes a hollow body which is provided with a passage and is formed of a base member ultrasonically welded to a bag and a hollow member forming a cover. The cover has a centrally disposed projection with which a flexible resilient disc is pressed against the passage in the base member. When there is excess CO2(gas) pressure in the container, the disc is lifted away from the base member at the opening and CO2 can flow through the passage to be discharged through the opening in the cover. One draw back of such a valve is that when the valve is manufactured the parts must be assembled in a particular manner keeping the parts centered in relation to each other. Such precise alignment of various parts, where a distinction must be made between top and bottom on some parts, requires additional mechanisms on packaging machines which add to the cost of manufacturing such bags.

Another valve design is disclosed in U.S. Pat. No. 3,799, 427 issued on Mar. 26, 1974 to Luigi Goglio. This patent discloses an improved valve in which a conical abutment is placed in the region of the passage opening and a viscous intermediate layer is added between the valve member and valve seat. Although this provides a better distinction between the open and the closed positions of the valve, the above-mentioned drawbacks continue to exist.

There remains several problems with the valve designs noted above. First, they require three or more parts that must be assembled. In addition, they each use a filter that must be attached to the side of the valve facing or in contact with the contents of the container, such as ground coffee. Each valve requires a certain degree of precision in forming the parts in order for them to fit together and work properly. The proceeding problems increase the cost and reliability of the valves.

SUMMARY OF THE INVENTION

Accordingly it is an object of the present invention to provide a valve designed to eliminate the problems noted above by simplifying valve construction while producing a more reliable valve. The valve comprises a valve body having a disc-like shape with a recess generally centered therein, an attachment flange formed integral with an open side of the valve body and a circular welding ridge integral with the attachment flange. At least one slotted valve opening provides a gas passageway through the valve body and communicating with the open end of the valve body, a valve plug in the form of a diaphragm is shaped to fit easily within the recess in the valve body. The valve diaphragm being made from a flexible resilient material. The valve diaphragm is coated on one side with a viscous liquid and is in contact with a valve seat.

BRIEF DESCRIPTION OF THE DRAWINGS

In the drawings, like reference numerals and numbers refer to like parts throughout the various views, and wherein:

FIG. 1 is a cross sectional view of FIG. 2 taken at 1—1 showing a preferred embodiment of a pressure relief valve;

FIG. 2 is a plan view of a preferred embodiment of the present invention showing one-half of the valve with a valve diaphragm partially broken away to expose a gas inlet slot;

FIG. 3 is an enlarged view of FIG. 1 taken at 3—3 showing a valve diaphragm, viscous liquid, and gas inlet slot; and FIG. 4 is partial sectional view of a second embodiment of the present invention showing an annular channel provided to allow piercing of a flexible container wall.

DESCRIPTION OF THE PREFERRED EMBODIMENTS

Referring first to FIG. 1, a pressure relief valve 10 of the type commonly used with flexible containers used to store and sell coffee is shown in cross-section. Relief valve 10 has two components, a valve body 12 and a valve diaphragm 16. The main elements of valve 10 comprise a valve body 12, an inlet passageway 14, a valve diaphragm 16, and an outlet passageway 18. The various structural elements of valve 10 will now be discussed followed by a functional description of valve assembly and operation.

Valve body 12 comprises a unitary structure that is preferably formed of a thermo-plastic, such as polyethylene, in an injection molding operation. Valve body 12 includes an inner face 20 designed for contact with contents of the flexible container such as coffee, especially ground coffee. An outer face 22 includes a mounting rim 24 that has a melt ridge 26 formed integral therewith. Valve 10 is attached to an inside wall 25 of a flexible container 27 by placing outer face 22 and melt ridge 26 in contact with the inside wall 25 of the container. Using either heat or ultrasonic energy melt ridge 26 and container wall 25 are melted together. In this manner valve 10 is located inside the container where it is protected from damage by the outside environment.

Inner face 20 includes a valve inlet surface 28. A valve chamber 30 is formed within valve body 12. Valve chamber 30 includes several features. Valve chamber 30 is defined by an end wall 32 and a chamber wall 34. Chamber 30 is substantially open at its outlet end 36, which is opposite its end wall 32. Forming a portion of end wall 32 is valve seat 38. Gas inlet passageway 14 allows gas to pass through end wall 32 thereby allowing gas to flow from inlet surface 28 to valve seat 38 and into valve chamber 30. Inlet passageway 14 is preferably formed by three inlet slots 40. Inlet slots 40 are preferably 0.125 inches long by 0.024 inches wide at their inlet ends 42(the slots are curved to match the diameter of their placement). However, a minimum of three slots of the size described, or their equivalent open area, should be used. This ensures proper operation of the valve in relieving gas pressure. The length of slots 40 is not important as to the passage of ground coffee grains. As shown in FIG. 1, inlet slots 40 have divergent sidewalls such that each inlet slot 40 has an inlet end 42 that is smaller in area than its outlet end 44. In a preferred embodiment inlet slot wall 46 has a five degree (5°) angle from vertical.

Referring FIGS. 1 and 2, at least one boss 48 projects into valve chamber 30 from chamber 34 and may be formed integral therewith. Preferably there are three bosses 48 or diaphragm retaining posts. The size of retaining posts 48 will be discussed below.

Valve diaphragm 16 is made from a resilient material, in preferred form it is made from silicone rubber having a durometer in the range of 45 d to 65 d, and preferably 55 d. Diaphragm 16 is therefore semi-rigid or stiff in that it is capable of being deformed yet will substantially return to its original shape. Diaphragm 16 can be very thin or fairly thick but is preferable 0.031 inches thick. Diaphragm 16 is sized and shaped to fit loosely within valve chamber 30, yet completely cover inlet slots 40. As shown in FIG. 3, valve seat surface 52 of diaphragm 16 is coated with a viscous liquid 54 in preferred form. The viscous liquid is preferably a silicone oil having a viscosity in the range of 50–100 cst.

As mentioned above valve body 12 is preferably injection molded as a unitary piece from a thermoplastic such as polyethylene. As noted above, diaphragm 16 is preferable made from silicone rubber. Thus the valve of the present invention is made from just two easily produced and assembled components. Due to its resilient nature, diaphragm 16 is easily pressed into place in valve chamber 30 by temporarily deforming it past retaining posts 48. Retaining posts 48 extend radially inwardly into valve chamber 30 a sufficient distance to retain diaphragm 16 within valve chamber 30 while not so far as to make it difficult to press diaphragm 16 past posts 48 during assembly. Hence it is shown that the valve of the present invention is a simple two piece construction made from parts that require a level of precision that is easy to achieve at a lower cost than previous valves.

As shown in FIG. 4, a second embodiment includes an annular channel 56. Channel 56 provides a clearance space for cutting a slot in container wall in that region. This provides a final exit path for the escaping gas.

The operation of valve 10 will now be discussed. As pressure within a container increases to a pressure greater than the ambient pressure against diaphragm 16, gas within the container passes through inlet slots 40 and contacts diaphragm 16. The higher than ambient gas must be great enough to overcome the resiliency of diaphragm 16 and surface tension forces between diaphragm 16, viscous liquid 54, and valve seat 38. When that condition is met gas passes around diaphragm 16 and out into the ambient surrounding through outlet passageway 18 and through a slot in the container formed in the area of outlet passageway 18. Usually only a small portion of diaphragm 16 is displaced during pressure relief. Viscous liquid 54 is usually sufficient to hold at least a portion of diaphragm 16 against valve seat 38. Retaining posts 48 ensure that diaphragm 16 is retained within valve chamber 30 in the event that diaphragm 16 becomes completely dislodged from valve seat 38. The resiliency of diaphragm 16 and surface tensions associated with viscous liquid 54 return diaphragm 16 to a fully seated position when pressures near equilibrium.

Viscous liquid 54 also helps to ensure that an air-tight seal is formed when diaphragm 16 is fully seated against valve seat 38. The preferred shape of inlet slots 40 has the unexpected result of substantially preventing ground coffee grains from contacting diaphragm 16 and reducing the effectiveness of the valve.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the legitimate and valid scope of the appended claims, appropriately interpreted in accordance with the doctrine of equivalents.

I claim:

1. A pressure relief valve for use with a sealable flexible container for storing and transporting food stuffs such as coffee, said pressure relief valve comprising:

a valve body having an inlet surface, a valve seat surface, at least one gas inlet passageway between said inlet surface and said valve seat surface, said valve body includes a recess, said recess formed by said valve seat surface, at least one enclosing sidewall and substantially open opposite said valve seat surface, said said at least one enclosing sidewall includes at least one valve diaphragm retaining boss extending radially inwardly; and a valve diaphragm formed from a resilient material, said valve diaphragm being substantially flat and having a valve seat contacting surface, said valve seat contacting surface being coated with a viscous liquid, said valve diaphragm being sized to avoid contact with said at least one enclosing sidewall, when substantially centered on said valve seat, and large enough that the resilient diaphragm is deformed will being inserted past said at least one valve diaphragm retaining boss, said at least one valve diaphragm retaining boss being spaced from said valve seat that said resilient diaphragm does not contact the diaphragm retaining boss in normal operation, normal operation being that pressure is relieved by said resilient diaphragm deforming such that only a portion of the diaphragm lifts off of the valve seat thereby allowing pressure release, the diaphragm retaining boss only present to prevent an unlikely dislodging of the diaphragm during installation of the valve onto an inner wall of the sealable flexible container.

2. A relief valve according to claim 1, wherein said valve recess enclosing sidewall includes a plurality of valve diaphragm retaining bosses formed integral therewith and sized to allow said diaphragm to pass deformably thereby during assembly of said valve and to retain said valve diaphragm within said valve chamber during installation of said valve into said container.

3. A relief valve according to claim 1, wherein a valve attachment ring is formed integral with an outer surface of said valve body, whereby said valve attachment ring is used to attach said valve to a flexible container.

4. A relief valve according to claim 1, wherein said viscous liquid is a silicone oil.

5. A relief valve according to claim 1, wherein said at least one gas inlet passageway between said valve inlet surface and said valve seat surface includes a slot shaped opening having diverging sidewalls such that an inlet end of said opening is smaller than an outlet opening, whereby said coffee, if in a ground condition, is substantially prevented from reaching said valve seat surface.

6. A relief valve according to claim 5, wherein at least one inlet passageway is further defined as being three arcuate slots.

7. A relief valve according to claim 5, wherein said inlet passageway is 0.024 inches wide at its inlet end and has diverging walls that are each five degrees from a centerline.

8. A relief valve according to claim 1, wherein said diaphragm is made from a silicone rubber having a durometer of between 45–65 d.

9. A relief valve according to claim 1, wherein said viscous liquid is a silicone oil having a viscosity of between 50 and 100 cts.

10. A pressure relief valve for use with a sealable flexible container for storing and transporting food stuffs such as coffee, said pressure relief valve comprising:

a one piece valve body having an inlet surface, a valve seat surface, a plurality of gas inlet passageways between said inlet surface and said valve seat surface, said valve body includes a recess, said recess having a wall connected at one end to an edge portion of said valve seat surface and another end being open thereby forming an outlet end forming a gas passageway outlet, said recess wall further including a plurality of valve diaphragm retaining bosses; and a valve diaphragm formed from a resilient material, said valve diaphragm being substantially flat and having a valve seat contacting surface, said valve seat contacting surface being coated with a viscous liquid, said valve diaphragm being sized with an outer periphery spaced from said wall and large enough to require deformation when being inserted into said recess past said valve diaphragm retaining bosses during assembly.

11. A relief valve according to claim 10, wherein said plurality of gas inlet passageways include three arcuate slots have divergent sidewalls such that an inlet end of each slot is smaller in cross-sectional area than an outlet end of each slot.

12. A relief valve according to claim 10, wherein said plurality of valve diaphragm retaining bosses includes three bosses extending radially inwardly from said valve chamber wall and are formed integral therewith.

13. A relief valve according to claim 10, wherein said valve diaphragm is made from silicone rubber having a durometer in the range of 45 to 65 d.

14. A relief valve according to claim 10, wherein said viscous liquid is silicone oil.

* * * * *